United States Patent [19]

Lee et al.

[11] Patent Number: 5,027,742

[45] Date of Patent: Jul. 2, 1991

[54] SUPERCRITICAL FLUIDS AS DILUENTS IN LIQUID SPRAY APPLICATION OF COATINGS

[75] Inventors: Chinsoo Lee, Charleston; Kenneth L. Hoy, St. Albans, both of W. Va.; Marc D. Donohue, Ellicot City, Md.

[73] Assignee: Union Carbide Chemicals and Plastics Technology Corporation, Danbury, Conn.

[21] Appl. No.: 397,974

[22] Filed: Aug. 24, 1989

Related U.S. Application Data

[60] Division of Ser. No. 133,068, Dec. 21, 1987, which is a continuation-in-part of Ser. No. 883,156, Jul. 8, 1986.

[51] Int. Cl.[5] ..... B05B 7/00

[52] U.S. Cl. ..... 118/300; 427/421; 427/422; 427/385.5; 239/10; 239/DIG. 1

[58] Field of Search ..... 118/300, 302; 427/27, 427/421, 422, 426, 384, 385.5; 239/9, 10, 299, 128, 597, 599, 432, 343, DIG. 1

[56] References Cited

U.S. PATENT DOCUMENTS

| | | | |
|---|---|---|---|
| 4,124,528 | 11/1978 | Modell | 252/411 |
| 4,189,914 | 2/1980 | Marek et al. | 60/726 |
| 4,375,387 | 3/1983 | deFilippi et al. | 202/169 |
| 4,582,731 | 4/1986 | Smith | 427/421 |
| 4,619,735 | 10/1986 | Norton | 162/135 |
| 4,734,227 | 3/1986 | Smith | 264/13 |
| 4,734,451 | 3/1986 | Smith | 118/300 X |
| 4,737,384 | 4/1988 | Murthy et al. | 427/369 |

FOREIGN PATENT DOCUMENTS

| | | |
|---|---|---|
| 2603664 | 8/1977 | Fed. Rep. of Germany . |
| 2853066 | 6/1980 | Fed. Rep. of Germany . |
| 55-84328 | 6/1980 | Japan . |
| 58-168674 | 10/1983 | Japan . |
| 59-16703 | 1/1984 | Japan . |
| 62-152505 | 7/1987 | Japan . |
| 868051 | 4/1988 | South Africa . |

OTHER PUBLICATIONS

Cobbs et al., "High Solids Coatings above 80% by Volume", pp. 175–192, presented at Water-Borne and Higher Solids Coatings Symposium, Mar. 10–12, 1980.

Francis, A. W., "Ternary Systems of Liquid Carbon Dioxide", J. Phys. Chem. 58:1099, Dec. 1954.

Smith, R. D. et al., "Direct Fluid Injection Interface for Capillary Supercritical Fluid Chromatography–Mass Spectrometry", J. Chromatog, 247(1982):231–243.

Krukonis, V., "Supercritical Fluid Nucleation of Difficult-to-Comminute Solids", paper presented at 1984 Annual Meeting, AIChE, San Francisco, Calif., 11/25–30/84.

Dandage, D. K. et al., "Structure Solubility Correlations: Organic Compounds and Dense Carbon Dioxide Binary Systems", Ind. Eng. Chem. Prod. Res. Dev. 24: 162–166 (1985).

Matson, D. W. et al., "Production of Powders and Films by the Rapid Expansion of Supercritical Solutions", J. Materials Science 22: 1919–1928 (1987).

McHugh, M. A. et al., "Supercritical Fluid Extraction, Principles and Practice", Butterworth Publishers (1986), Contents and Appendix.

Matson, D. W. et al., "Production of Fine Powders by the Rapid Expansion of Supercritical Fluid Solutions", Advances in Ceramics, vol. 21, pp. 109–121 (1987).

Kitamura, Y. et al., "Critical Superheat for Flashing of Superheated Liquid Jets", Ind. Eng. Chem. Fund. 25:206–211 (1986).

Petersen, R. C. et al., "the Formation of Polymer Fibers From the Rapid Expansion of SCF Solutions", Pol. Eng. & Sci. (1987), vol. 27, p. 169.

*Primary Examiner*—Shrive Beck
*Assistant Examiner*—Alain Bashore
*Attorney, Agent, or Firm*—Morris N. Reinisch

[57] ABSTRACT

A liquid coatings application process and apparatus is provided in which supercritical fluids, such as supercritical carbon dioxide fluid, are used to reduce to application consistency viscous coatings compositions to allow for their application as liquid sprays.

2 Claims, 6 Drawing Sheets

SUPERCRITICAL FLUIDS AS DILUENTS IN LIQUID SPRAY APPLICATION OF COATINGS

This application is a division of prior U.S. application Ser. No. 133,068, filing date 12/21/87, which is a continuation-in-part of application Ser. No. 883,156, filing date 7/8/86.

FIELD OF THE INVENTION

This invention relates in general to a process and apparatus for coating substrates. In one aspect, this invention is directed to a process and apparatus for coating substrates in which a supercritical fluid, such as supercritical carbon dioxide fluid, is used as a viscosity reduction diluent for coating formulations.

BACKGROUND OF THE INVENTION

Prior to the present invention, the liquid spray application of coatings, such as lacquers, enamels and varnishes, was effected solely through the use of organic solvents as viscosity reduction diluents. However, because of increased environmental concern, efforts have been directed to reducing the pollution resulting from painting and finishing operations. For this reason there has been a great deal of emphasis placed on the development of new coatings technologies which diminish the emission of organic solvent vapors. A number of technologies have emerged as having met most but not all of the performance and application requirements, and at the same time meeting emission requirements and regulations. They are: (a) powder coatings, (b) water-borne dispersions, (c) water-borne solutions, (d) non-aqueous dispersions, and (e) high solids coatings. Each of these technologies has been employed in certain applications and each has found a niche in a particular industry. However, at the present time, none has provided the performance and application properties that were initially expected.

Powder coatings, for example, while providing ultra low emission of organic vapors, are characterized by poor gloss or good gloss with heavy orange peel, poor definition of image gloss (DOI), and poor film uniformity. Pigmentation of powder coatings is often difficult, requiring at times milling and extrusion of the polymer-pigment composite mixture followed by cryogenic grinding. In addition, changing colors of the coating often requires its complete cleaning, because of dust contamination of the application equipment and finishing area.

Water borne coatings cannot be applied under conditions of high relative humidity without serious coating defects. These defects result from the fact that under conditions of high humidity, water evaporates more slowly than the organic cosolvents of the coalescing aid, and as might be expected in the case of aqueous dispersions, the loss of the organic cosolvent/coalescing aid interferes with film formation. Poor gloss, poor uniformity, and pin holes unfortunately often result. Additionally, water borne coatings are not as resistant to corrosive environments as are the more conventional solvent borne coatings.

Coatings applied with organic solvents at high solids levels avoid many of the pitfalls of powder and water-borne coatings. However, in these systems the molecular weight of the polymer has been decreased and reactive functionality has been incorporated therein so that further polymerization and crosslinking can take place after the coating has been applied. It has been hoped that this type of coating will meet the ever-increasing regulatory requirements and yet meet the most exacting coatings performance demands. However, there is a limit as to the ability of this technology to meet the performance requirement of a commercial coating operation. Present high solids systems have difficulty in application to vertical surfaces without running and sagging of the coating. Often they are also prone to cratering and pin holing of the coating. If they possess good reactivity, they often have poor shelf and pot life. However, if they have adequate shelf stability, they cure and/or crosslink slowly or require high temperature to effect an adequate coating of the substrate.

U.S. Pat. No. 4,582,731 (Smith) discloses a method and apparatus for the deposition of thin films and the formation of powder coatings through the molecular spray of solutes dissolved in organic and supercritical fluid solvents. The molecular sprays disclosed in the Smith patent are composed of droplets having diameters of about 30 Anstroms. These droplets are more than $10^6$ to $10^9$ less massive than the droplets formed in conventional application methods which Smith refers to as "liquid spray" applications. The disclosed method of depositing thin films also seeks to minimize, and preferably eliminate, the presence of solvent within the film deposited upon a substrate. This result is preferably accomplished through the maintenance of reduced pressure in the spray environment. However, low solvent concentration within the deposited film leads to the same problems encountered through the use of high colids coatings. The maintenance of reduced pressures is also not feasible for most commerical coating applications. Furthermore, the spray method disclosed by Smith utilizes very high solvent to solute ratios, thereby requiring undesirably high solvent usage and requiring prohibitively long application times in order to achieve coatings having sufficient thicknesses to impart the desired durability to the coating.

Clearly, what is needed is an environmentally safe, non-polluting diluent that can be used to thin very highly viscous polymer and coatings compositions to liquid spray application consistency. Such a diluent would allow utilization of the best aspects of organic solvent borne coatings applications and performance while reducing the environmental concerns to an acceptable level. Such a coating system could meet the requirements of shop- and field-applied liquid spray coatings as well as factory-applied finishes and still be in compliance with environmental regulations.

It is accordingly an object of the present invention to demonstrate the use of supercritical fluids, such as supercritical carbon dioxide fluid, as diluents in highly viscous organic solvent borne and/or highly viscous non-aqueous dispersions coatings compositions to dilute these compositions to application viscosity required for liquid spray techniques.

A further object of the invention is to demonstrate that the method is generally applicable to all organic solvent borne coatings systems.

These and other objects will readily become apparent to those skilled in the art in the light of the teachings herein set forth.

SUMMARY OF THE INVENTION

In its broad aspect, this invention is directed to a process and apparatus for the liquid spray application of coatings to a substrate wherein the use of environmentally undesirable organic diluents is minimized. The process of the invention comprises:

(1) forming a liquid mixture in a closed system, said liquid mixture comprising:
   (a) at least one polymeric compound capable of forming a coating on a substrate; and
   (b) at least one supercritical fluid, in at least an amount which when added to (a) is sufficient to render the viscosity of said mixture of (a) and (b) to a point suitable for spray application;

(2) spraying said liquid mixture onto a substrate to form a liquid coating thereon.

The invention is also directed to a liquid spray process as described immediately above to which at least one active organic solvent (c) is admixed with (a) and (b), prior to the liquid spray application of the resulting mixture to a substrate.

The invention is also directed to an apparatus in which the mixture of the components of the liquid spray mixture can be blended and sprayed onto an appropriate substrate.

DESCRIPTION OF THE DRAWINGS

A more detailed understanding of the invention will be had by reference to the drawings wherein.

DETAILED DESCRIPTION OF THE INVENTION

Figure 1:
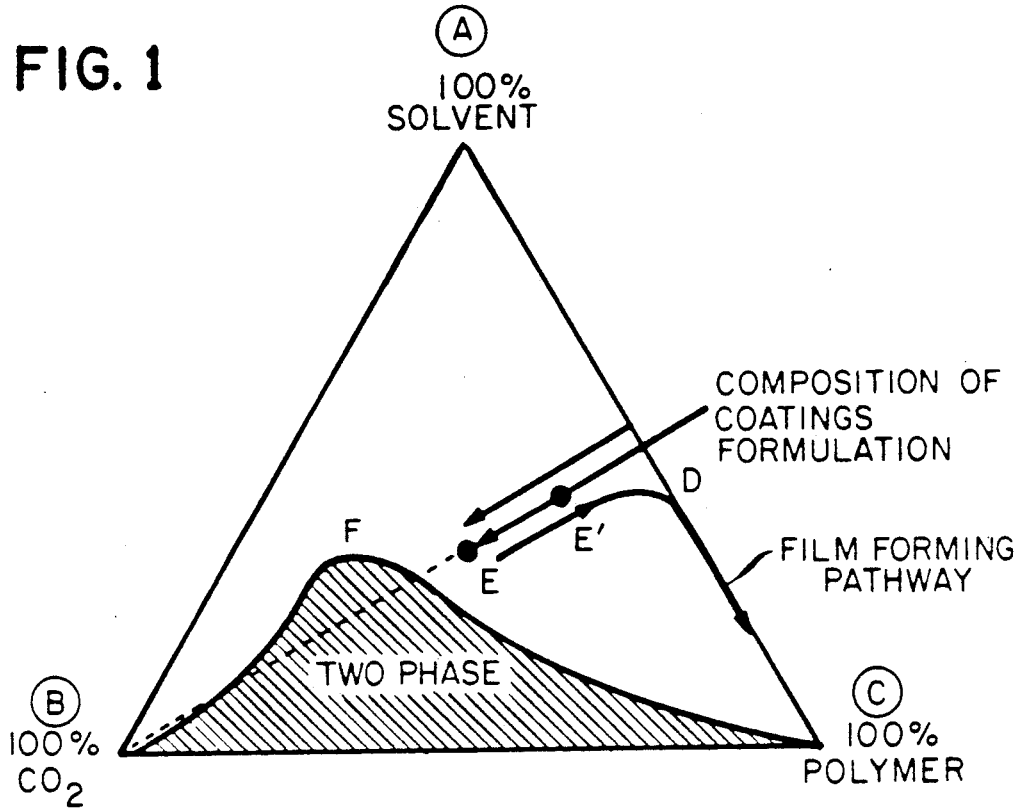
FIG. 1 is a phase diagram of supercritical carbon dioxide spray coating.

It has been found that by using the process and apparatus of the present invention, coatings can be applied to a wide variety of substrates in a manner which poses a reduced environmental hazard. Consequently, the use of organic diluents as vehicles for coating formulations can be greatly reduced by utilizing supercritical fluids, such as supercritical carbon dioxide, therewith.

Because of its importance to the claimed process, a brief discussion of relevant supercritical fluid phenomena is warranted.

At high pressures above the critical point, the resulting supercritical fluid, or "dense gas", will attain densities approaching those of a liquid and will assume some of the properties of a liquid. These properties are dependent upon the fluid composition, temperature, and pressure.

The compressibility of supercritical fluids is great just above the critical temperature where small changes in pressure result in large changes in the density of the supercritical fluid. The "liquid-like" behavior of a supercritical fluid at higher pressures results in greatly enhanced solubilizing capabilities compared to those of the "subcritical" compound, with higher diffusion coefficients and an extended useful temperature range compared to liquids. Compounds of high molecular weight can often be dissolved in the supercritical fluid at relatively low temperatures.

An interesting phenomenon associated with supercritical fluids is the occurrence of a "threshold pressure" for solubility of a high molecular weight solute. As the pressure is increased, the solubility of the solute will often increase by many orders of magnitude with only a small pressure increase.

Near supercritical liquids also demonstrate solubility characteristics and other pertinent properties similar to those of supercritical fluids. The solute may be a liquid at the supercritical temperatures, even though it is a solid at lower temperatures. In addition, it has been demonstrated that fluid "modifiers" can often alter supercritical fluid properties significantly, even in relatively low concentrations, greatly increasing solubility for some solutes. These variations are considered to be within the concept of a supercritical fluid as used in the context of this invention. Therefore, as used herein, the phrase "supercritical fluid" denotes a compound above, at or slightly below the critical temperature and pressure of that compound.

Examples of compounds which are known to have utility as supercritical fluids are given in Table 1.

TABLE 1

EXAMPLES OF SUPERCRITICAL SOLVENTS

| Compound | Boiling Point (°C.) | Critical Temperature (°C.) | Critical Pressure (atm) | Critical Density (g/cm$^3$) |
|---|---|---|---|---|
| $CO_2$ | −78.5 | 31.3 | 72.9 | 0.448 |
| $NH_3$ | −33.35 | 132.4 | 112.5 | 0.235 |
| $H_2O$ | 100.00 | 374.15 | 218.3 | 0.315 |
| $N_2O$ | −88.56 | 36.5 | 71.7 | 0.45 |
| Methane | −164.00 | −82.1 | 45.8 | 0.2 |
| Ethane | −88.63 | 32.28 | 48.1 | 0.203 |
| Ethylene | −103.7 | 9.21 | 49.7 | 0.218 |
| Propane | −42.1 | 96.67 | 41.9 | 0.217 |
| Pentane | 36.1 | 196.6 | 33.3 | 0.232 |
| Methanol | 64.7 | 240.5 | 78.9 | 0.272 |
| Ethanol | 78.5 | 243.0 | 63.0 | 0.276 |
| Isopropanol | 82.5 | 235.3 | 47.0 | 0.273 |
| Isobutanol | 108.0 | 275.0 | 42.4 | 0.272 |
| Chlorotrifluoromethane | 31.2 | 28.0 | 38.7 | 0.579 |
| Monofluoromethane | 78.4 | 44.6 | 58.0 | 0.3 |
| Cyclohexanol | 155.65 | 356.0 | 38.0 | 0.273 |

The utility of any of the above-mentioned compounds as supercritical fluids in the practice of the present invention will depend upon the polymeric compound(s) and active solvent(s) used because the spray temperature cannot exceed the temperature at which thermal degradation of any component of the liquid spray mixture occurs.

Due to the low cost, low toxicity and low critical temperature of carbon dioxide, supercritical carbon dioxide fluid is preferably used in the practice of the present invention. However, use of any of the aforementioned supercritical fluids and mixtures thereof are to be considered within the scope of the present invention.

The solvency of supercritical carbon dioxide is like that of a lower aliphatic hydrocarbon (e.g., butane, pentane or hexane) and, as a result, one can consider supercritical carbon dioxide fluid as a replacement for the hydrocarbon diluent portion of a conventional solvent borne coating formulations. Moreover, while lower aliphatic hydrocarbons are much too volatile for use in conventional coatings formulation because of the inherent explosive and fire hazard they present, carbon dioxide is non-flammable, non-toxic and environmentally acceptable. Safety benefits therefore also result in its use in the claimed process.

The polymeric compounds suitable for use in this invention as coating materials are any of the polymers known to those skilled in the coatings art. Again, the only limitation to their use in the present invention is their degradation at the temperatures or pressures involved with their admixture with the supercritical fluid. These include vinyl, acrylic, styrenic and interpolymers of the base vinyl, acrylic and styrenic monomers; polyesters, oilless alkyds, alkyds and the like; polyurethanes, two package polyurethane, oil-modified polyurethanes, moisture-curing polyurethanes and thermoplastic urethanes systems; cellulosic esters such as acetate butyrate and nitrocellulose; amino-resins such as urea formaldehyde, malamine formaldehyde and other aminoplast polymers and resins materials; natural gums and resins. Also included are crosslinkable film forming systems.

The polymer component of the coating composition is generally present in amounts ranging from 5 to 65 wt. %, based upon the total weight of the polymer(s), solvent(s) and supercritical fluid diluent. Preferably, the polymer component should be present in amounts ranging from about 15 to about 55 wt. % on the same basis.

The supercritical fluid should be present in quantities such that a liquid mixture is formed which possesses a viscosity such that it may be applied as a liquid spray. Generally, this requires the mixture to have a viscosity of less than about 150 cps. Examples of known supercritical fluids have been set forth priviously herein. The viscosity of the mixture of components must be less than that which effectively prohibits the liquid spray application of the mixture. Generally, this requires that the mixture possess a viscosity of less than about 150 cps. Preferably, the viscosity of the mixture of components ranges from about 10 cps to about 100 cps. Most preferably, the viscosity of the mixture of components ranges from about 20 cps to about 50 cps.

If supercritical carbon dioxide fluid is employed as the supercritical fluid diluent, it preferably should be present in amounts ranging from 10 to about 60 wt. % based upon the total weight of components (a), (b) and (c). Most preferably, it is present in amounts ranging from 20–60 wt. % on the same basis, thereby producing a mixture of components (a), (b) and (c) having viscosities from about 20 cps to about 50 cps.

If a polymeric component is mixed with increasing amounts of supercritical fluid in the absence of hydrocarbon solvent, the composition may at some point separate into two distinct phases. This perhaps is best illustrated by the phase diagram in FIG. 1 wherein the supercritical fluid is supercritical carbon dioxide fluid. In FIG. 1 the vertices of the triangular diagram represent the pure components of the coating formulation. Vertex A is the active solvent, vertex B carbon dioxide, vertex C the polymeric material. The curved line BFC represents the phase boundary between one phase and two phases. The point D represents a possible composition of the coating composition before the addition of supercritical carbon dioxide. The point E represents a possible composition of the coating formulation. The addition of supercritical carbon dioxide has reduced the viscosity of the viscous coatings composition to a range where it can be readily atomized through a properly designed liquid spray apparatus. After atomization, a majority of the carbon dioxide vaporizes, leaving substantially the composition of the original viscous coatings formulation. Upon contacting the substrate, the remaining liquid mixture of the polymer and solvent(s) component(s) will flow to produce a uniform, smooth film on the substrate. The film forming pathway is illustrated in FIG. 1 by the line segments EE'D (atomization and decompression) and DC (coalescense and film formation).

The active solvent(s) suitable for the practice of this invention generally include any solvent or mixtures of solvents which is miscible with the supercritical fluid and is a good solvent for the polymer system. It is recognized that some organic solvents, such as cyclohexanol, have utility as both conventional solvents and as supercritical fluid diluents. As used herein, the term "active solvent" does not include solvents in the supercritical state.

Among suitable active solvents are: ketones such as acetone, methyl ethyl ketone, methyl isobutyl ketone, miestyl oxide, methyl amyl ketone, cyclohexanone and other aliphatic ketones; esters such as methyl acetate, ethyl acetate, alkyl carboxylic esters, methyl t-butyl ethers, dibutyl ether, methyl phenyl ether and other aliphatic or alkyl aromatic ethers; glycol ethers such ethoxyethanol, butoxyethanol, ethoxypropanol, propoxyethanol, butoxpropanol and other glycol ethers; glycol ether ester such as butoxyethoxy acetate, ethyl ethoxy proprionate and other glycol ether esters; alcohols such methanol, ethanol, propanol, 2-propanol, butanol, amyl alcohol and other aliphatic alcohols; aromatic hydrocarbons such as toluene, xylene, and other aromatics or mixtures of aromatic solvents; nitro alkanes such as 2-nitropropane. Generally, solvents suitable for this invention must have the desired solvency characteristics as aforementioned and also the proper balance of evaporation rates so as to insure good coating formation. A review of the structural relationships important to the choice of solvent or solvent blend is given by Dileep et al., *Ind. Eng. Che.* (Product Research and Development) 24, 162, 1985 and Francis, A. W., *J. Phys. Chem.* 58, 1099, 1954.

In order to minimize the unnecessary release of any active solvent present in the liquid spray mixture, the amount of active solvent used should be less than that required to produce a mixture of polymeric compounds and active solvent having a viscosity which will permit its application by liquid spray techniques. In other words, the inclusion of active solvent(s) should be minimized such that the diluent effect due to the presence of the supercritical fluid diluent is fully utilized. Generally, this requires that the mixture of polymeric compounds and active solvent have a viscosity of not less than about 150 centipoise (cps). Preferably, the solvent(s) should be present in amounts ranging from 0 to about 70 wt. % based upon the total weight of the polymer(s), solvent(s) and supercritical fluid diluent. Most preferably, the solvent(s) are present in amounts ranging from about 5 to 50 wt. % on the same basis.

The coating formulation employed in the process of the present invention include a polymeric compound(s), a supercritical fluid diluent(s), and optionally, an active solvent(s). Pigments, drying agents, anti-skinning agents and other additives well known in the art may also be included on the compositions applied by the claimed process.

Solvents other than the active solvents may also be used in the practice of the present invention. These solvents are typically those in which the polymeric compound(s) have only limited solubility. However, these solvents are soluble in the active solvent and therefore constitute an economically attractive route to viscosity reduction of the spray mixture. Examples of these solvents include lower hydrocarbon compounds.

The present process may be used to apply coatings by the application of liquid spray techniques to a variety of substrates. The choice of substrates in therefore not critical in the practice of the present invention. Examples of suitable substrates include wood, glass, ceramic, metal and plastics.

The environment in which the liquid spray of the present invention is conducted is not narrowly critical. However, the pressure therein must be less than that required to maintain the supercritical fluid component of the liquid spray mixture in the supercritical state. Preferably, the present invention is conducted under conditions at or near atmospheric pressure.

In the practice of the present invention, liquid spray droplets are produced which generally have an average diameter of 1 micron or greater. Preferably, these droplets have average diameters of from about 10 to 1000 microns. More preferably, these droplets have average diameters of from about 100 to about 800 microns.

If curing of the coating composition present upon the coated substrate is required, it may be performed at this point by conventional means, such as allowing for evaporation of the active solvent, application of heat or ultraviolet light, etc.

In the case of supercritical fluid carbon dioxide usage, because the supercritical fluid escaping from the spray nozzle could cool to the point of condensing solid carbon dioxide and any ambient water vapor present due to high humidity in the surrounding spray environment, the spray composition is preferably heated prior to atomization.

Through the practice of the present invention, films may be applied to substrates such that the cured films have thicknesses of from about 0.2 to about 4.0 mils. Preferably, the films have thicknesses of from about 0.5 to about 2.0 mils, while most preferably, their thicknesses range from about 0.8 to about 1.4 mils.

It is to be understood that a specific sequence of addition of the components of the liquid spray mixture (a), (b) and optionally (c) is not necessary in the practice of the present invention. However, it is often preferred to initially mix the polymer(s) (a) and any active solvent(s) (c) used due to the relatively high viscosities normally exhibited by many polymer components.

Figure 2:
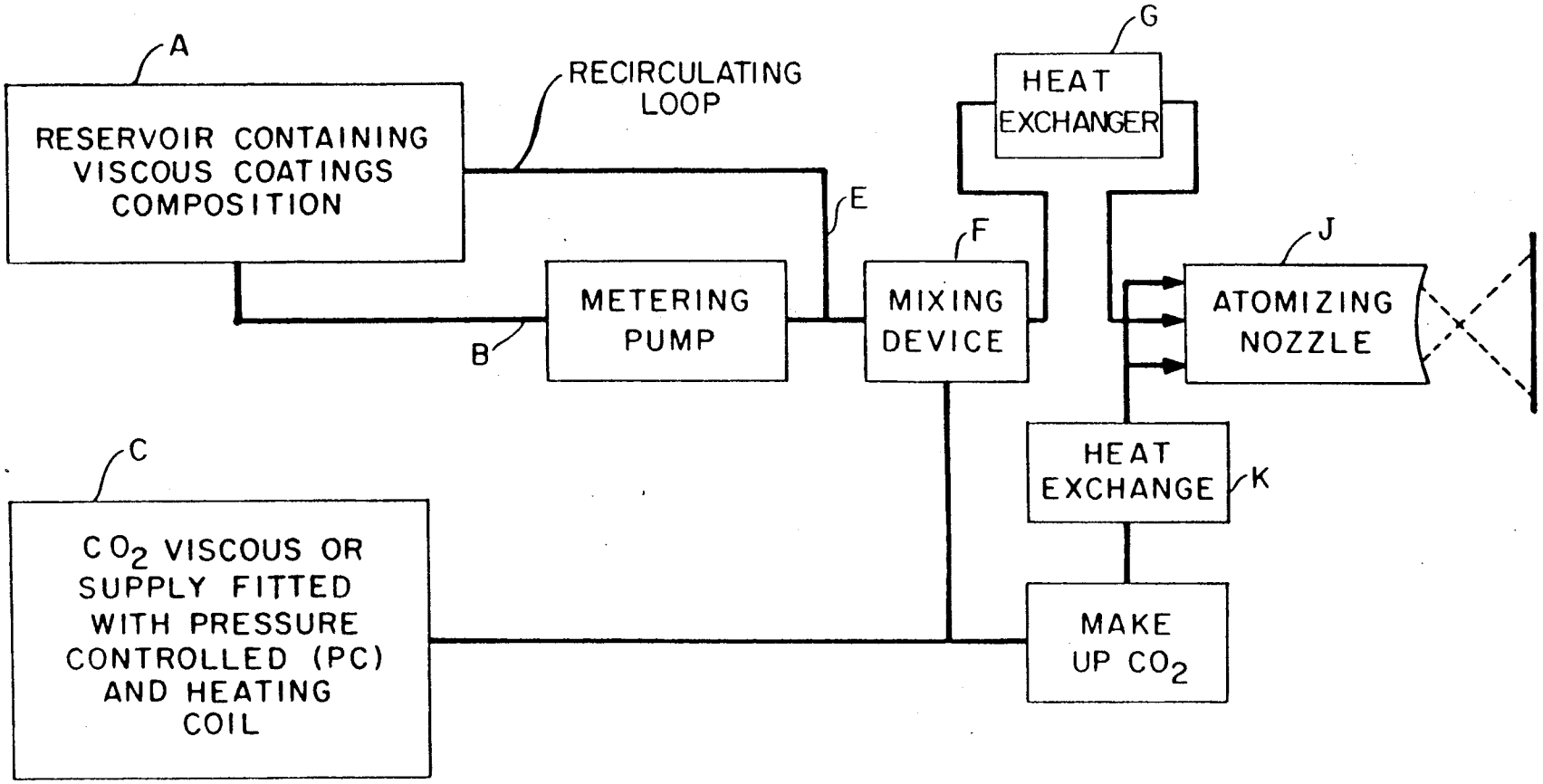
FIG. 2 is a schematic diagram of the liquid spray apparatus employed in the process of the invention.

In another embodiment, the invention is directed to an apparatus useful for blending and dispensing of the liquid spray coating formulations. The apparatus in which the process of this invention is conducted is illustrated in FIG. 2. In this Figure, the viscous coatings composition is fed from reservoir A to the suction side of metering gear pump B. Carbon dioxide, used as the supercritical fluid for the purposes of this Figure, is fed to the system from the tank C which is provided with a pressure controller and heating coil to adjust the pressure to the desired level. The carbon dioxide is fed into the system through a pressure controller to the input side of the metering pump B but downstream from the circulation loop E. Sufficient carbon dioxide is admitted to the stream so as to bring the composition into the critical composition range (EE') as previously noted above with respect to FIG. 1. The mixture is then fed through a mixing device F, where it is mixed until the composition has a uniformly low viscosity. Thereafter, the mixture is heated through heat exchanger G to avoid condensation of carbon dioxide and ambient water vapor. The mixture is then forced out spray nozzle J where atomization takes place. The atomized coating composition solution may then be directed into a fan produced with make up gaseous carbon dioxide through the angled orifices of the spray nozzle. The make up gas is heated through heat exchanger K.

Figure 3:
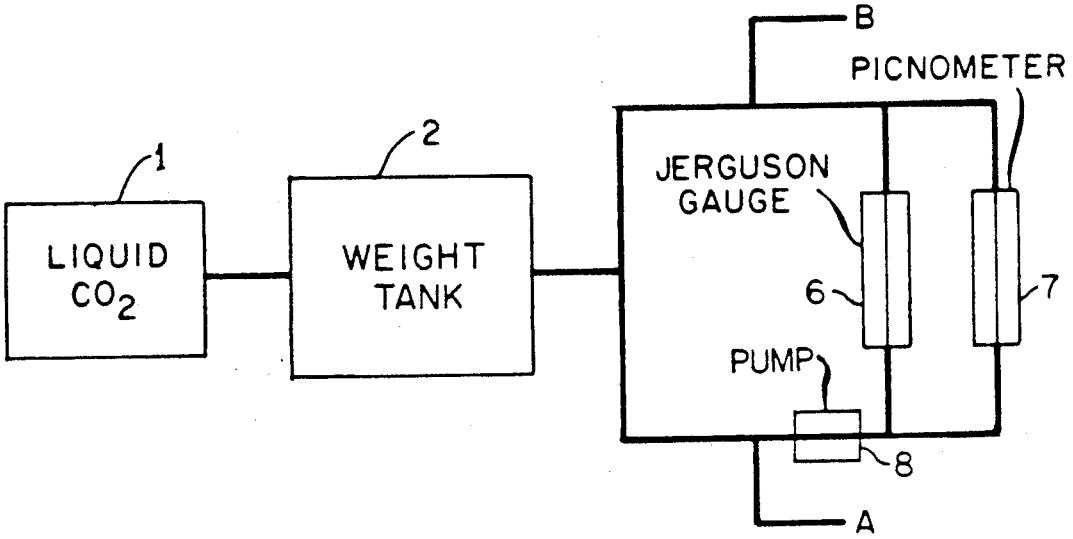
FIG. 3 is a schematic diagram of the apparatus which can be used to determine the phase relationship of supercritical carbon dioxide in solvent borne coating compositions.

The phase relationship of supercritical fluids in coating compositions for applications as a liquid spray can be determined by the apparatus described in FIG. 3. A viscous solution of polymeric(s) components and any active solvent(s) is loaded into the apparatus by first evacuating the system through valve port (B). A known amount of the viscous coatings solutions is then admitted to the system through the valve port (A). Valve port (A) is then closed and the pump (8) is started to insure circulation of the viscous solution and the elimination of gas pockets in the system. The system is pressurized to greater than the critical pressure of the supercritical fluid, which in the case of carbon dioxide is approximately 1040 psi, from weight tank (2) which has been previously charged from the cylinder (1) until the required pressure is attained. In the case of carbon dioxide, weight tank (2) is heated to generate the required pressure of carbon dioxide. From the known weight of the solution and the weight of the supercritical fluid admitted, the composition of the mixture in the system may be calculated. After the system has been allowed to circulate to reach thermal equilibrium (approximately an hour) and the mixture seems to be uniform and in one phase as observed through Jerguson gauge (6), the in-line picnometer (7) is sealed off from and removed from the system, weighed, and the density of the mixture calculated. The picnometer is then reconnected to the system and circulation through it re-established. The high pressure viscometer is then sealed off and the fall time of the rolling ball recorded at three different incline angles. From the density and fall times, the viscosity may be calculated from the equation:

$$h = K \times (\rho_b - \rho_1) \times t$$

where:

K = constant $\rho_b$ = ball density $\rho_1$ = liquid density t = rolling ball time.

Figure 4:
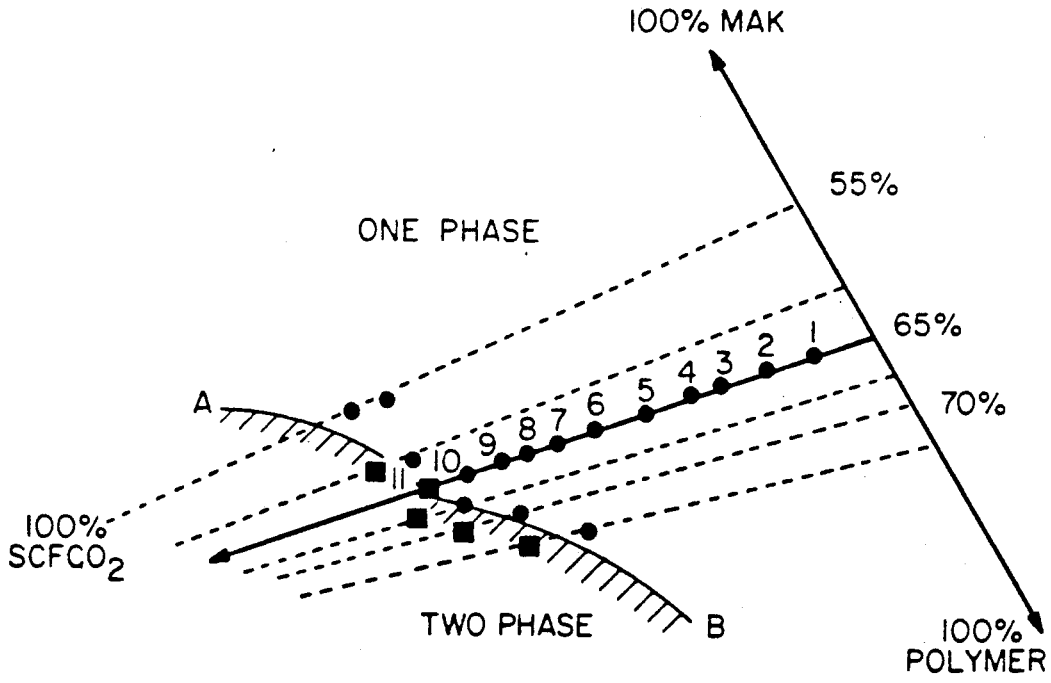
FIG. 4 is a section of a phase diagram showing a composition for which the viscosity has been determined.
Figure 5:
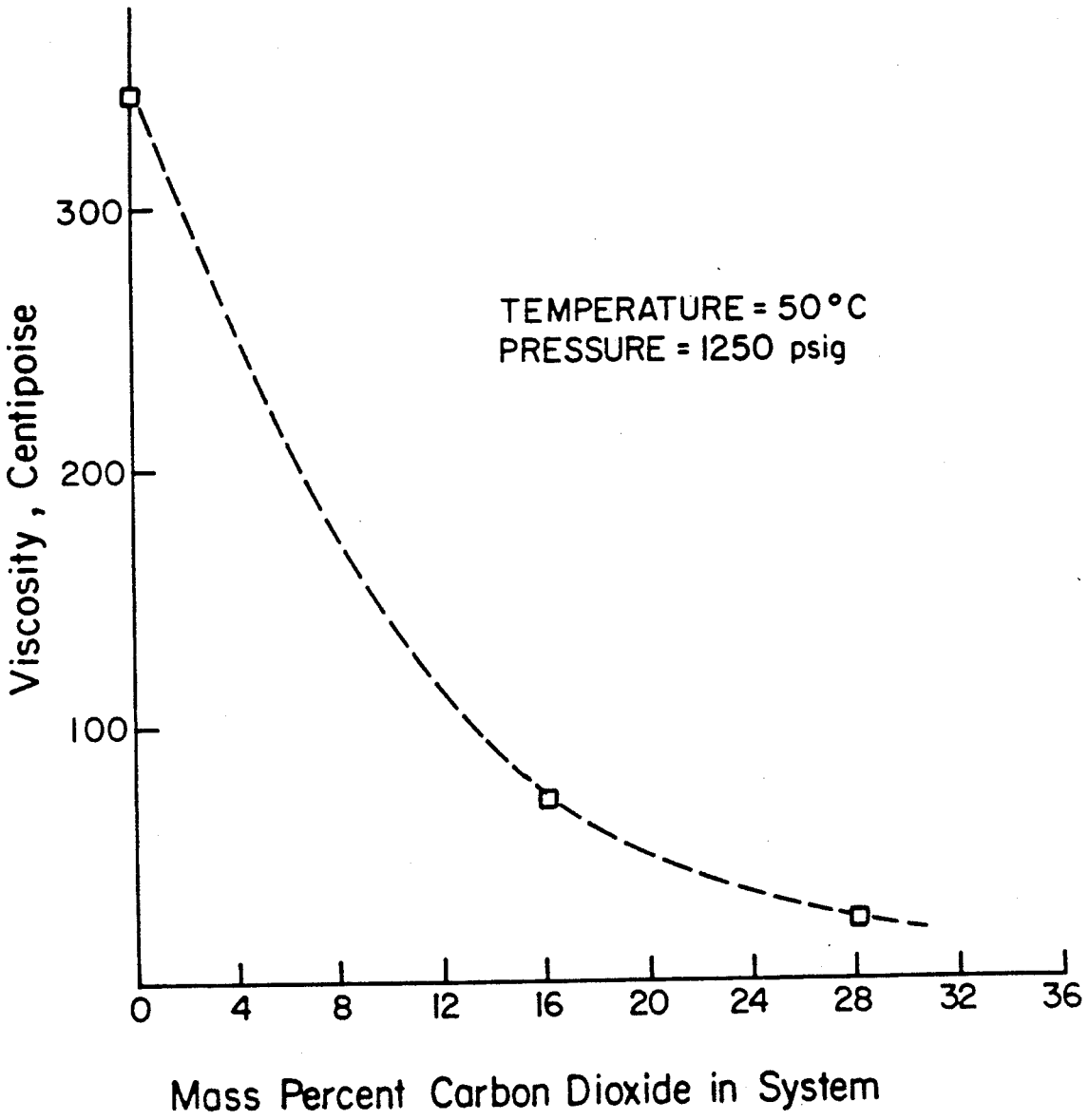
FIG. 5 is a graph illustrating the viscosity versus composition relationship for a 65 percent viscous polymer solution in methyl amyl ketone (MAK).
Figure 6:
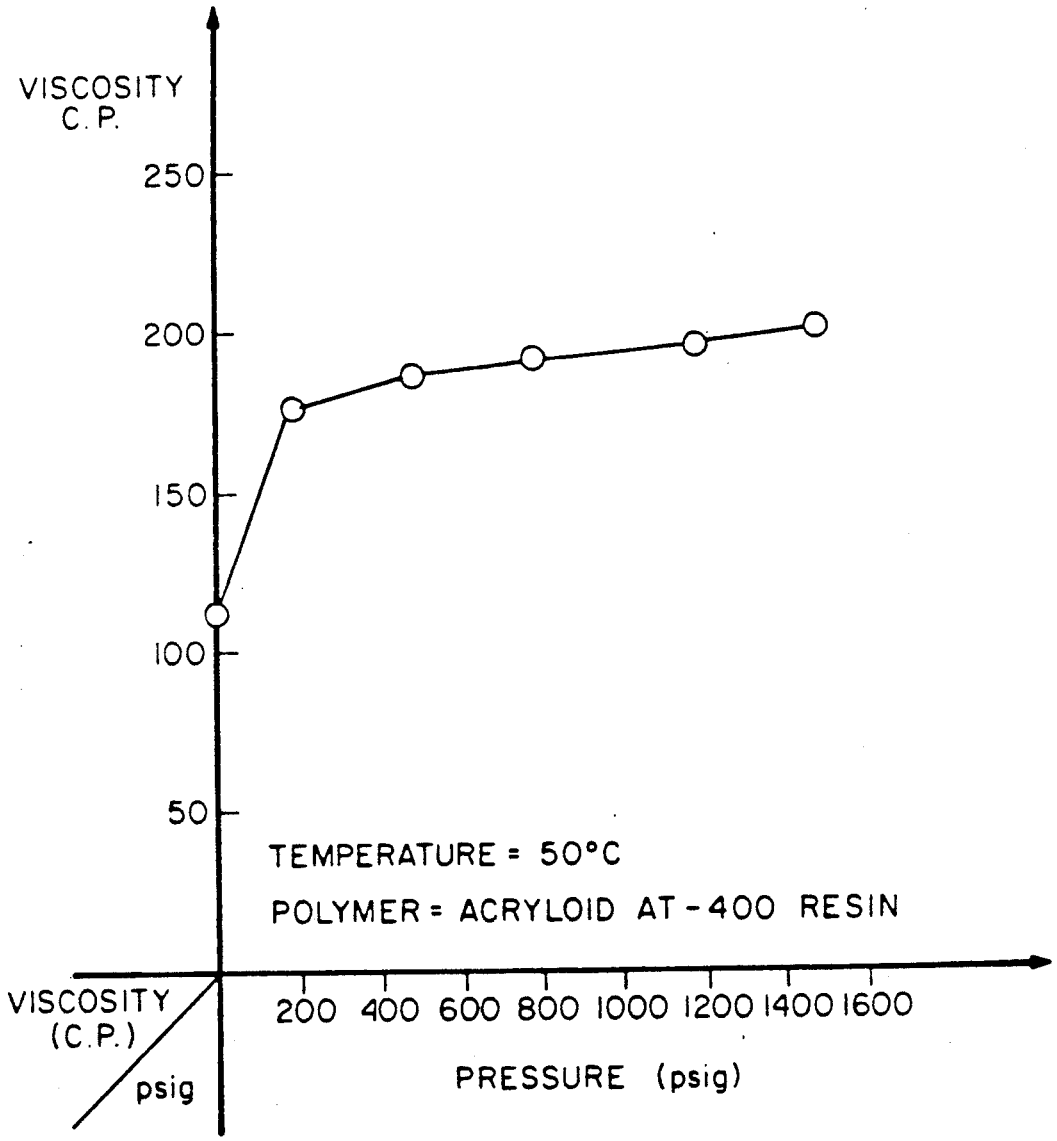
FIG. 6 is a graph showing viscosity when pressure is applied to a viscous polymeric solution.

The response of the system to the addition of supercritical fluid is a decrease in viscosity. This relationship is illustrated in FIGS. 4 and 5 which were generated using supercritical carbon dioxide fluid. FIG. 4 is a section of the phase diagram showing the composition for which the viscosity has been determined. In FIG. 4, the phase boundary is illustrated by the line segment AB; the points 1–11 represents the compositions of the mixtures for which the viscosities were measured. The phase boundary is illustrated by the shaded line AB. FIG. 5 illustrates the viscosity versus composition relationship for a 65% viscous polymer solution in methyl amyl ketone (MAK). The pressure was 1250 psig and the temperature 50° C. The polymer employed was Acryloid TM AT-400, a product of Rohm and Haas Company which contains 75% nonvolatile acrylic polymer dissolved in 25% MAK.

EXAMPLE

The following Example illustrates the practice of the present process in a continuous mode.

Table 2 contains a listing of the equipment used in conducting the procedure described in the Example.

TABLE 2

| item # | Description |
|---|---|
| 1. | Linde bone-dry-grade liquid carbon dioxide in size K cylinder with eductor tube |
| 2. | Cooling heat exchanger |
| 3. | Hoke cylinder #8HD3000, 3.0-liter volume, made of 304 stainless steel, having double end connectors, 1800-psig pressure rating, mounted on scale |
| 4. | Circle Seal pressure relief valve P168-344-2000 set at 1800 psig |
| 5. | Vent Valve |
| 6. | Nitrogen gas supply |
| 7. | Graco double-acting piston pump model #947-963 with 4-ball design and Teflon packings mounted in #5 Hydra-Cat Cylinder Slave Kit #947-943 |
| 8. | Graco standard double-acting primary piston pump model #207-865 with Teflon packings |
| 9. | Graco Variable Ratio Hydra-Cat Proportioning Pump unit model #226-936 with 0.9:1 to 4.5:1 ratio range |
| 10. | Graco President air motor model #207-352 |
| 11. | Utility compressed air at 95 psig supply pressure |
| 12. | Graco air filter model #106-149 |
| 13. | Graco air pressure regulator model #206-197 |
| 14. | Graco air line filter model #214-848 |
| 15. | Graco pressure relief valve model #208-317 set at 3000 psig |
| 16. | Graco pressure relief valve model #208-317 set at 3000 psig |
| 17. | Graco two-gallon pressure tank model #214-833 |
| 18. | Graco air pressure regulator model #171-937 |
| 19. | Graco pressure relief valve model #103-437 set at 100 psig |
| 20. | Graco high-pressure fluid heater model #226-816 |
| 21. | Graco high-pressure fluid filter model #218-029 |
| 22. | Graco check valve model #214-037 with Teflon seal |
| 23. | Graco check valve model #214-037 with Teflon seal |
| 24. | Graco static mixer model #500-639 |
| 25. | Graco high-pressure fluid heater model #226-816 |
| 26. | Graco high-pressure fluid filter model #218-029 |
| 27. | Kenics static mixer |
| 28. | Graco fluid pressure regulator model #206-661 |
| 29. | Jerguson high-pressure site glass series T-30 with window size #6 rated for 2260 psig pressure at 200 F. temperature |
| 30. | Nordson A4B circulating airless hand spray gun model #125-200 and spray nozzle model #0004/08 with 0.009-inch orifice diameter and spray width rated at 8–10 inches |
| 31. | Bonderite TM 37 polished 24-gauge steel panel, 6-inch by 12-inch size |
| 32. | Zenith single-stream gear pump, model #HLB-5592-30CC, modified by adding a thin teflon gasket to improve metal-to-metal seal, with pump drive model #4204157, with 15:1 gear ratio. |
| 33. | Circle Seal pressure relief valve P168-344-2000 set at 2000 psig |
| 34. | Drain from circulation loop |

TABLE 2-continued

Figure 7:
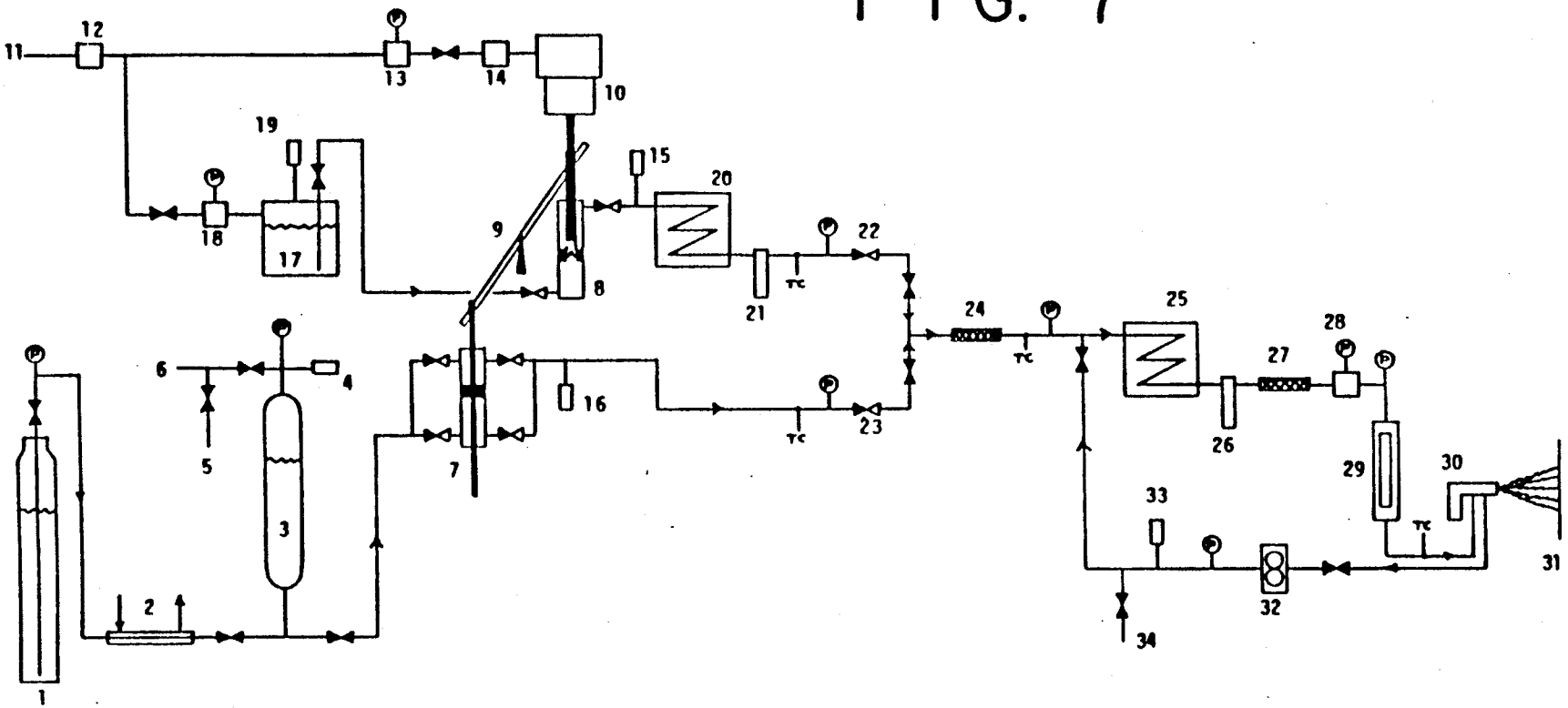
FIG. 7 is a schematic diagram of a spray apparatus that can be used in the practice of the present invention.

The apparatus listed in Table 2 above was assembled as shown in the schematic representation contained in FIG. 7. Rigid connections were made with Dekuron ¼-inch diameter, 0.036-inch thick, seamless, welded, type 304 stainless steel hydraulic tubing ASTM A-269 with 5000-psi pressure rating, using Swagelock fittings. The pressure tank (17) was connected to the pump (8) using a Graco ⅜-inch static-free nylon high-pressure hose model #061-221 with 3000-psi pressure rating. All other flexible connections were made using Graco ¼-inch static-free nylon high-pressure hoses model #061-214 with 5000-psi pressure rating. The spray gun (30) was connected to the Graco spray hose by using a Nordson 3/16-inch static-free nylon high-pressure whip hose model #828-036.

The coating concentrate and carbon dioxide were pumped and proportioned using a Graco Variable Ratio Hydra-Cat Proportioning Pump unit (9). It proportions two fluids together at a given volume ratio by using two piston pumps that are slaved together. The piston rods for each pump are attached to opposite ends of a shaft that pivots up and down on a center fulcrum. The volume ratio is varied by sliding one pump along the shaft, which changes the stroke length. The pumps are driven on demand by an air motor (10). Pumping pressure is controlled by the air pressure that drives the air motor. The pumps are both double-acting; they pump on upstroke and downstroke. The primary pump (8) was used to pump the coating solution. It was of standard design, having one inlet and one outlet. It fills through a check valve at the bottom and discharges through a check valve at the top. A third check valve is located in the piston head, which allows liquid to flow from the bottom compartment to the top compartment when the piston is moving downward. This type of pump is designed to be used with low feed pressure, typically below 100 psi. The coating solution was supplied to the primary pump (8) from a two-gallon pressure tank (17). After being pressurized in the pump to spray pressure, the solution was then heated in an electric heater (20) to reduce its viscosity (to aid mixing with carbon dioxide), filtered in a fluid filter (21) to remove particulates, and fed through a check valve (22) into the mix point with carbon dioxide. The secondary pump (7) on the proportioning Pump unit (9) was used to pump the liquid carbon dioxide. A double-acting piston pump (7) with a four-check-valve design was used because of the high vapor pressure of carbon dioxide. The pump has an inlet and an outlet on each side of the piston, and no flow occurs through the piston. The proportion of carbon dioxide pumped into the spray solution is varied by moving the pump along the moving shaft. Bone-dry-grade liquid carbon dioxide was supplied from cylinder (3) to the secondary pump. Air or gaseous carbon dioxide in the Hoke cylinder (3) was vented through valve (5) as the cylinder was filled. It is sometimes helpful to cool the liquid carbon dioxide by using a cooler heat exchanger (2) in order to lower the vapor pressure of carbon dioxide going into the Hoke Cylinder (3) to below the vapor pressure in cylinder (1). The Hoke cylinder (3) was mounted on a scale so that the amount of carbon dioxide in it could be weighed. After the Hoke cylinder (3) was filled with liquid carbon dioxide, it was pressurized with nitrogen from supply (6) to increase the presssure in the cyclinder (3) to above the vapor pressure of the carbon dioxide, in order to prevent cavitation in pump (7) caused by pressure drop across the inlet check valve during the suction stroke. After being pressurized to spray pressure in pump (7), the liquid carbon dioxide was fed unheated through a check valve (23) to the mix point with the coating solution. After the coating solution and carbon dioxide were proportioned together, the mixture was mixed in static mixer (24) and pumped on demand into a circulation loop, which circulates the mixture at spray pressure and temperature to or through the spray gun (30). The mixture was heated in an electric heater (25) to obtain the desired spray temperature and filtered in a fluid filter (26) to remove particulates. Fluid pressure regulator (28) was installed to lower the spray pressure below the pump pressure, if desired or to help maintain a constant spray pressure. A Jerguson site glass (29) was used to examine the phase condition of the mixture. Circulation flow in the circulation loop was obtained through the use of gear pump (32). By adjusting the valves which control the flow to and from the gear pump, the single-pass flow to the spray gun (30) could be obtained instead of a circulating flow.

A clear acrylic coating concentrate having a total weight of 7430 grams was prepared by mixing the following materials:

4830 grams of Acryloid TM AT-400 Resin (Rohm & Haas Company), which contains 75% nonvolatile acrylic polymer dissolved in 25% methyl amyl ketone, 1510 grams of Cymel TM 323 Resin (American Cyanamid Company), which contains 80% nonvolatile melamine polymer dissolved in 20% isobutanol solvent, 742 grams of methyl amyl ketone, 348 grams of n-butanol solvent.

The coating concentrate contained 65.0% nonvolatile polymer solids and 35.0% volatile organic solvent. The pressure tank (17) was filled with the concentrate and pressurized with air to 50 psig. The Hoke cylinder (3) was filled with liquid carbon dioxide at room temperature and then pressurized to 1075 psig with compressed nitrogen. Pump (7) was placed along the pivoting shaft to give 60% of maximum piston displacement. The pumps were primed and the unit purged to produce a spray solution with steady composition. The circulation gear pump (32) was set to a rate of 30 revolutions per minute. Test panel (31) was mounted vertically within a spray hood in which atmospheric pressure existed. The spray pressure was adjusted to 1750 psig and the spray temperature to 60 C. A clear one-phase solution was seen in the Jerguson site glass (29). The liquid spray mixture contained 46% nonvolatile polymer solids, 24% volatile organic solvents, and 30% carbon dioxide. A liquid spray coating was applied to the Test panel (31). The test panel (31) was then baked in a convection oven for twenty minutes at a temperature of 120° C. The clear coating that was produced had an average thickness of 1.2 mils, a distinctness of image of 80%, and a gloss of 90% (measured at an angel of 20 degrees from perpendicular).

Although the invention has been illustrated by the preceding Example, it is not to be construed as being limited to the material employed therein, but rather, the invention relates to the generic area as hereinbefore disclosed. Various modifications and embodiments thereof can be made without departing from the spirit and scope thereof.

What is claimed is:

1. An apparatus for the liquid spray application of a coating to a substrate wherein the use of environmentally undesirable organic solvent is minimized, said apparatus comprised of, in combination:

(1) means for supplying at least one polymeric compound capable of forming a continuous, adherent coating;

(2) means for supplying at least one active organic solvent;

(3) means for supplying supercritical carbon dioxide fluid;

(4) means for forming a liquid mixture of components supplied from (1)-(3);

(5) means for spraying said liquid mixture in the form of droplets having an average diameter of 1 micron or greater onto a substrate.

2. The apparatus of claim 1 further comprising (6) means for heating any of said components and/or said liquid mixture of components.

* * * * *